US005677117A

United States Patent [19]

Yamamoto et al.

[11] Patent Number: 5,677,117

[45] Date of Patent: Oct. 14, 1997

[54] SILVER HALIDE PHOTOGRAPHIC MATERIAL AND METHOD OF PROCESSING THE SAME

[75] Inventors: Seiichi Yamamoto; Nobuaki Inoue, both of Kanagawa, Japan

[73] Assignee: Fuji Photo Film Co., Ltd., Kanagawa, Japan

[21] Appl. No.: 430,860

[22] Filed: Apr. 28, 1995

[30] Foreign Application Priority Data

Apr. 28, 1994 [JP] Japan ..... 6-91563

[51] Int. Cl.[6] ..... G03C 1/04

[52] U.S. Cl. ..... 430/533; 430/531; 430/264; 430/598; 430/603; 430/627

[58] Field of Search ..... 430/264, 598, 430/603, 627, 531, 533

[56] References Cited

U.S. PATENT DOCUMENTS 3,459,790 8/1969 Smith ..... 560/178

5,004,669 4/1991 Yamada et al. ..... 430/264

5,352,563 10/1994 Kawasaki et al. ..... 430/264

FOREIGN PATENT DOCUMENTS 0019035 1/1994 Japan .

619035 1/1994 Japan .

*Primary Examiner*—Hoa Van Le

*Attorney, Agent, or Firm*—Sughrue, Mion, Zinn, Macpeak & Seas, PLLC

[57] ABSTRACT

A silver halide photographic material is disclosed, which comprises a support having thereon at least one light-sensitive silver halide emulsion layer comprising silver halide grains sensitized with a selenium or tellurium sensitizer and having a silver chloride content of 50 mol % or more, wherein the silver halide emulsion layer or other hydrophilic colloid layer contains polymer latex having an active methylene group. The silver halide photographic material provides high storage stability and less pressure marks.

19 Claims, No Drawings

SILVER HALIDE PHOTOGRAPHIC MATERIAL AND METHOD OF PROCESSING THE SAME

FIELD OF THE INVENTION

The present invention relates to a silver halide photographic material and the method for processing the same.

BACKGROUND OF THE INVENTION

Photographic materials with excellent reproducibility of the original, stable processing solutions and simplified replenishment are desired in the field of photomechanical process in order to deal with the diversity and complexity of printed matter.

In particular, the original in the process of line original photographing is prepared by pasting photocomposed characters, handwritten characters, illustrations, halftone photographs and the like. Accordingly, images differing in density and line width are mixed in the original, therefore, process cameras, photographic materials and image formation methods for finishing good reproduction of these originals have been strongly desired. On the other hand, enlargement (spread) or reduction (choke) of halftone photographs is widely conducted in the photomechanical process for catalogs and large posters, but the lines become coarse in the photomechanical process using dot enlargement, which leads to photographing of blurred dots. The line number per inch becomes larger than that of the originals in the case of reduction, which leads to photographing of finer dots. Accordingly, an image forming method which has a wider latitude is required in order to maintain reproducibility of dot gradation.

A method of obtaining line originals or halftone dot images having high contrast and high density of blackening with the image part and the non-image part distinctly distinguished is known as a system satisfying the requirement for wide latitude which comprises processing a lith type silver halide photographic material comprising silver chlorobromide (a silver chloride content is at least 50% or more) with a hydroquinone developing solution of extremely reduced effective concentration of sulfite ion (generally 0.1 mol per liter or less). However, develpment is very unstable to air oxidation in this method because the sulfite concentration in the developing solution is low, and various endeavors and contrivances have been made and utilized to keep the solution activity stable, but processing speed is extremely slow and operation efficiency is thereby reduced, such is the state of the art.

Therefore, an image formation system which can provide superhigh contrast photographic characteristics has been desired to relieve the instability of image formation by a developing method as described above (a lith developing system) and to develop with a processing solution having excellent storage stability. One method was proposed as such a system as disclosed in U.S. Pat. Nos. 4,166,742, 4,168,977, 4,221,857, 4,224,401, 4,243,739, 4,272,606 and 4,311,781, in which a specific acylhydrazine compound is added to a surface latent image type silver halide photographic material and the material is processed using a developing solution containing 0.15 mol/liter or more of a sulfite preservative and having excellent storage stability at pH from 11.0 to 12.3, to thereby obtain a superhigh contrast negative image having gamma exceeding 10.

However, the above image formation system has drawbacks such that sensitivity, gamma or maximum density lowers due to the reduction of pH of a developing solution and the rise of bromide ion concentration as a result of processing of a large amount of films. On the other hand, when films to be processed are few, black peppers occur extensively and at the same time maximum density lowers due to the extreme reduction of sulfite concentration contained as a preservative or the rise of pH as a result of the fatigue of the developing solution with the lapse of time. A method to cope with these drawbacks is to increase the replenishment amount of the developing solution. However, this method is accompanied by the increment of the production cost of the developing solution and waste solution. Therefore, a system in which the fluctuation of sensitivity, the reduction of Dmax and the occurrence of black peppers are little without increasing the replenishment amount of the developing solution has been strongly desired.

A method which uses a photographic material containing a silver halide chemically sensitized with a selenium compound to reduce the sensitivity fluctuation, the reduction of Dmax and the occurrence of black peppers is disclosed in JP-A-6-19035 (the term "JP-A" as used herein means a "published unexamined Japanese patent application") responding to the above requirement.

In addition, when a silver halide photographic material is preserved and aged, sensitivity fluctuates or fog is generated in some cases. As a result of these, sufficient reproducibility of the originals cannot be obtained sometimes, and the improvement thereof is desired. It is also desired to improve pressure mark properties of silver halide photographic materials.

SUMMARY OF THE INVENTION

One object of the present invention is to provide a silver halide photographic material which provides less sensitivity fluctuation and generates less pressure marks with the lapse of time.

Another object of the present invention is to provide a silver halide photographic material which can provide high sensitivity, high contrast (for example, gamma of 10 or more) and high density of blackening, and a method of image formation.

Further object of the present invention is to provide a silver halide photographic material having reduced sensitivity, gamma and Dmax, even if pH of the processing solution is lowered or a bromide ion concentration of the processing solution is increased as a result of processing of a large amount of films.

The above objects of the present invention have been attained by a silver halide photographic material comprising a support having thereon at least one light-sensitive silver halide emulsion layer, wherein the emulsion of said emulsion layer comprises silver halide grains sensitized with a selenium or tellurium sensitizer and having a silver chloride content of 50 mol % or more, and said silver halide emulsion layer or other hydrophilic colloid layer contains polymer latex represented by the following formula (I):

$$-(D)_w-(A)_x-(B)_y-(C)_z- \quad (I)$$

wherein D represents a repeating unit derived from an ethylenically unsaturated monomer having an active methylene group, A represents a repeating unit derived from an ethylenically unsaturated monomer the homopolymer of which has a glass transition temperature of 35° C. or less, other than D, B represents a repeating unit derived from an ethylenically unsaturated monomer, other than D and A, C represents a repeating unit derived from an ethylenically unsaturated monomer having a carboxyl group, and w, x, y and z each represents percent by weight ratio of each component, w is from 0.5 to 40, x is from 60 to 99, y is from 0 to 50, and z is from 0.5 to 20, and w+x+y+z=100.

DETAILED DESCRIPTION OF THE INVENTION

Polymer latexes represented by formula (I) which are used in the present invention are described in detail below.

An ethylenically unsaturated monomer having an active methylene group which is represented by D is represented by the following formula (IV):

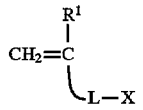

(IV)

wherein $R^1$ represents a hydrogen atom, an alkyl group having from 1 to 4 carbon atoms (e.g., methyl, ethyl, n-propyl, n-butyl) or a halogen atom (e.g., chlorine, bromine), and preferably represents a hydrogen atom, a methyl group or a chlorine atom.

L represents a single bond or a divalent linking group, and specifically represented by the following formula:

$$\text{—}(L^1)_m\text{—}(L^2)_n\text{—}$$

$L^1$ represents —CON($R^2$)— (wherein $R^2$ represents a hydrogen atom, an alkyl group having from 1 to 4 carbon atoms, or a substituted alkyl group having from 1 to 6 carbon atoms), —COO—, —NHCO—, —OCO—,

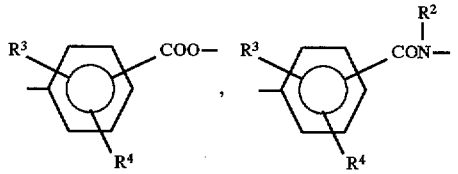

(wherein $R^3$ and $R^4$ each represents hydrogen, hydroxyl, halogen, or substituted or unsubstituted alkyl, alkoxy, acyloxy or aryloxy), $L^2$ represents a linking group which links $L^1$ with X, m represents 0 or 1, and n represents 0 or 1. A linking group represented by $L^2$ is specifically represented by the following formula:

$$\text{—}(X^1)_p\text{—}(J^1\text{—}X^2)_q\text{—}(J^2\text{—}X^3)_r\text{—}(J^3)_s\text{—}$$

wherein $J^1$, $J^2$ and $J^3$ may be the same or different and each represents —CO—, —$SO_2$—, —CON($R^5$)— (wherein $R^5$ represents hydrogen, alkyl (having from 1 to 6 carbon atoms), substituted alkyl (having from 1 to 6 carbon atoms), —$SO_2$N($R^5$)— ($R^5$ has the same meaning as above), —N($R^5$)—$R^6$— ($R^5$ has the same meaning as above, and $R^6$ represents alkylene having from 1 to about 4 carbon atoms), —N($R^5$)—$R^6$—N($R^7$)— ($R^5$ and $R^6$ have the same meaning as above, and $R^7$ represents hydrogen, alkyl (having from 1 to 6 carbon atoms), substituted alkyl (having from 1 to 6 carbon atoms)), —O—, —S—, —N($R^5$)—CO—N($R^7$)— ($R^5$ and $R^7$ have the same meaning as above), —N($R^5$)—$SO_2$—N($R^7$)— ($R^5$ and $R^7$ have the same meaning as above), —COO—, —OCO—, —N($R^5$)$CO_2$— ($R^5$ has the same meaning as above), and —N($R^5$)CO— ($R^5$ has the same meaning as above).

p, q, r and s represent 0 or 1.

$X^1$, $X^2$ and $X^3$ may be the same or different and each represents a substituted or unsubstituted alkylene group having from 1 to 10 carbon atoms, a substituted or unsubstituted aralkylene group, or a substituted or unsubstituted phenylene group, and the alkylene group may be straight chain or branched. Examples of the alkylene group include methylene, methylmethylene, dimethylmethylene, dimethylene, trimethylene, tetramethylene, pentamethylene, hexamethylene, decylmethylene and methoxyethylene, examples of the aralkylene group include benzylidene, and examples of the phenylene group include p-phenylene, m-phenylene, methylphenylene, methoxyphenylene and chlorophenylene.

X represents a monovalent group containing an active methylene group, and preferred examples include $R^8$—CO—$CH_2$—COO—, NC—$CH_2$—COO—, $R^8$—CO—$CH_2$—CO—, and $R^8$—CO—$CH_2$—CON($R^5$)—, wherein $R^5$ has the same meaning as above, and $R^8$ represents a substituted or unsubstituted alkyl group having from 1 to 12 carbon atoms (e.g., methyl, ethyl, n-propyl, n-butyl, t-butyl, n-nonyl, 2-methoxyethyl, 4-phenoxybutyl, benzyl, 2-methanesulfonamidoethyl), a substituted or unsubstituted aryl group (e.g., phenyl, p-methylphenyl, p-methoxyphenyl, o-chlorophenyl), an alkoxy group (e.g., methoxy, ethoxy, methoxyethoxy, n-butoxy), a cycloalkyloxy group (e.g., cyclohexyloxy), an aryloxy group (e.g., phenoxy, p-methylphenoxy, o-chlorophenoxy, p-cyanophenoxy) an amino group, or a substituted amino group (e.g., methylamino, ethylamino, dimethylamino, butylamino).

In the above, the specific examples of the substituents for the substituted alkyl, alkoxy, acyloxy, aryloxy, alkylene, aralkylene, phenylene, aryl, and amino groups include a halogen atom, an alkoxy group, etc.

Specific examples of ethylenically unsaturated monomers having an active methylene group represented by D in the polymers represented by formula (I) of the present invention are shown below, but the present invention is not limited thereto.

M-1 2-Acetoacetoxyethyl methacrylate
M-2 2-Acetoacetoxyethyl acrylate
M-3 2-Acetoacetoxypropyl methacrylate
M-4 2-Acetoacetoxypropyl acrylate
M-5 2-Acetoacetamidoethyl methacrylate
M-6 2-Acetoacetamidoethyl acrylate
M-7 2-Cyanoacetoxyethyl methacrylate
M-8 2-Cyanoacetoxyethyl acrylate
M-9 N-(2-Cyanoacetoxyethyl)acrylamide
M-10 2-Propionylacetoxyethyl acrylate
M-11 N-(2-Propionylacetoxyethyl)methacrylamide
M-12 N-4-(Acetoacetoxybenzyl)phenylacrylamide
M-13 Ethylacryloylacetate
M-14 Acryloylmethylacetate
M-15 N-Methacryloyloxymethylacetoacetamide
M-16 Ethylmethacryloylacetoacetate
M-17 N-Allylcyanoacetamide
N-18 Methylacryloylacetoacetate
M-19 N-(2-Methacryloyloxymethyl)cyanoacetamide
M-20 p-(2-Acetoacetyl)ethylstyrene
M-21 4-Acetoacetyl-1-methacryloylpiperazine
M-22 Ethyl-α-acetoacetoxy methacrylate
M-23 N-Butyl-N-acryloyloxyethylacetoacetamide
M-24 p-(2-Acetoacetoxy)ethylstyrene The ethylenically unsaturated monomer providing a repeating unit represented by A is a monomer the homopolymer of which has a glass transition temperature of 35° C. or less, and specific examples thereof include alkyl acrylate (e.g., methyl acrylate, ethyl acrylate, n-butyl acrylate, n-hexyl acrylate, benzyl acrylate, 2-ethylhexyl acrylate, n-dodecyl acrylate), alkyl methacrylate (e.g., n-butyl methacrylate, n-hexyl methacrylate, 2-ethylhexyl methacrylate, n-dodecyl methacrylate), dienes (e.g., butadiene, isoprene), vinyl esters (e.g., vinyl acetate, vinyl propionate).

More preferred monomer is a monomer the homopolymer of which has a glass transition temperature of 10° C. or less, and particularly preferred examples thereof are alkyl acrylate with alkyl side chain having 2 or more carbon atoms (e.g., ethyl acrylate, n-butyl acrylate, 2-ethylhexyl acrylate), alkyl methacrylate with alkyl side chain having 6 or more carbon atoms (e.g., n-hexyl methacrylate, 2-ethylhexyl methacrylate), and dienes (e.g., butadiene, isoprene).

The value of the glass transition temperature of the above polymers is described in J. Brandrup, E. H. Immergut, *Polymer Handbook*, 3rd Edition, VI/209 to VI/277, John Wiley & Sons, 1989.

The repeating unit represented by B is a repeating unit other than A, that is, a repeating unit derived from the monomer the homopolymer of which has a glass transition temperature of more than 35° C.

Specific examples thereof include acrylic esters (e.g., t-butyl acrylate, phenyl acrylate, 2-naphthyl acrylate), methacrylic esters (e.g., methyl methacrylate, ethyl methacrylate, 2-hydroxyethyl methacrylate, benzyl methacrylate, 2-hydroxypropyl methacrylate, phenyl methacrylate, cresyl methacrylate, 4-chlorobenzyl methacrylate, ethylene glycol dimethacrylate), vinyl esters (e.g., vinyl benzoate, pivaloyloxyethylene), acrylamides (e.g., acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, diacetoneacrylamide), methacrylamides (e.g., methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide), styrenes (e.g., styrene, methylstyrene, dimethylstyrene, trimethylstyrene, ethylstyrene, isopropylstyrene, chlorostyrene, methoxystyrene, acetoxystyrene, chlorostyrene, dichlorostyrene, bromostyrene, vinylbenzoate methyl ester), divinylbenzene, acrylonitrile, methacrylonitrile, N-vinylpyrrolidone, N-vinyloxazolidone, vinylidene chloride, and phenyl vinyl ketone.

The ethylenically unsaturated monomer providing a repeating unit represented by C in the polymer represented by formula (I) of the present invention is a monomer having a carboxyl group as disclosed in JP-B-60-15935, JP-B-45-3832, JP-B-53-28086 (the term "JP-B" as used herein means an "examined Japanese patent publication"), and U.S. Pat. No. 3,700,456, which is copolymerized for the purpose of improving the stability of latex.

Examples of such monomers include the following compounds:

Acrylic acid; methacrylic acid; itaconic acid; maleic acid; monoalkyl itaconate, e.g., monomethyl itaconate and monoethyl itaconate; monoalkyl maleate, e.g., monomethyl maleate and monoethyl maleate; citraconic acid; and acid.

These acids may be salts of alkali metal (e.g., Na, K) or ammonium ion.

w, x, y and z each represents percent by weight ratio of each monomer component in the polymer, w is from 0.5 to 40 wt %, preferably from 0.5 to 30 wt %, and particularly preferably from 1 to 20 wt %, x is from 60 to 99.5 wt %, preferably from 70 to 99.5 wt %, and particularly preferably from 75 to 99 wt %, y is from 0 to 50 wt %, preferably from 0 to 35 wt %, and particularly preferably from 0 to 25 wt %, and z is from 0.5 to 20 wt %, and particularly preferably from 1 to 10 wt %.

Preferred examples of polymer latexes represented by formula (I) of the present invention are shown below. The numerals in the parentheses indicate percent by weight of each monomer component in the copolymer.

P-1 Ethyl acrylate/M-1/acrylic acid copolymer (85/10/5)

P-2 n-Butyl acrylate/M-1/methacrylic acid copolymer (85/5/10)

P-3to P-7 n-Butyl acrylate/M-1/acrylic acid copolymer (w/x/z)

P-3 w/x/z=95/2/3

P-4 w/x/z=92/5/3

P-5 w/x/z=89/8/3

P-6 w/x/z=81/16/3 p-7 w/x/z=72/25/3

P-8 n-Butyl acrylate/styrene/M-1/methacrylic acid copolymer (65/20/5/10)

P-9 Methyl acrylate/M-4/methacrylic acid copolymer (80/15/5)

P-10 n-Butyl acrylate/M-5/acrylic acid copolymer (85/10/5)

P-11 n-Butyl acrylate/M-7/methacrylic acid copolymer 85/10/5)

P-12 2-Ethyhexyl acrylate/M-15/methacrylic acid copolymer (90/5/5)

P-13 n-Butyl acrylate/M-1/M-17/acrylic acid copolymer (75/5/15/5)

Polymer latexes of the present invention are prepared according to well known emulsion polymerization methods and preferred particle size is within the range of from 0.01 to 1.0 μm. Emulsion polymerization is carried out by emulsifying monomers in water or a mixed solvent of water and organic solvents compatible with water (e.g., methanol, ethanol, acetone) preferably using at least one emulsifier and a radical polymerization initiator at from 30° C. to about 100° C., preferably from 40° C. to about 90° C. The amount of the organic solvents compatible with water is from 0 to 100%, and preferably from 0 to 50%, in volume ratio based on water.

Polymerization reaction is generally carried out using from 0.05 to 5 wt % of a radical polymerization initiator and, if necessary, from 0.1 to 10 wt % of an emulsifier, based on the monomers to be polymerized. Examples of radical polymerization initiators include azobis compounds, peroxides, hydroperoxides, and redox solvents, for example, potassium persulfate, ammonium persulfate, tert-butylperoctoate, benzoyl peroxide, isopropylcarbonate, 2,4-dichlorobenzyl peroxide, methyl ethyl ketone peroxide, cumene hydroperoxide, dicumyl peroxide, 2,2'-azobisisobutyrate, and 2,2'-azobis(2-amidinopropane) hydrochloride.

Examples of emulsifiers include anionic, cationic, amphoteric and nonionic surfactants as well as water-soluble polymers, for example, sodium laurate, sodium dodecylsulfate, sodium 1-octoxycarbonylmethyl-1-octoxycarbonylmethanesulfonate, sodium laurylnaphthalenesulfonate, sodium laurylbenzenesulfonate, sodium laurylphosphate, cetyltrimethylammonium chloride, dodecyltrimethyleneammonium chloride, N-2-ethylhexylpyridinium chloride, polyoxyethylenenonylphenyl ether, polyoxyethylenesorbitanlauryl ester, polyvinyl alcohol, emulsifiers and water-soluble polymers disclosed in JP-B-53-6190.

A polymerization initiator, concentration, polymerization temperature, reaction time and the like in emulsion polymerization can, of course, be widely and easily changed according to the purpose.

Further, the emulsion polymerization reaction can be carried out in such a manner that all the amounts of monomer surfactants and mediums are put in the vessel prior to the addition of a polymerization initiator, or polymerization may be carried out while dropping a part or the entire amount of each component, according to necessity.

With respect to the kinds and synthesis methods of polymer latexes and monomers having an active methylene group represented by D in the polymers represented by formula (I) of the present invention, the following patents can be referred to, in addition to the above, for example, U.S. Pat. Nos. 3,459,790, 3,619,195, 3,929,482, 3,700,456, German Patent 2,442,165, EP 13,147, JP-A-50-73625 and JP-A-50-146331.

The silver halide in the silver halide emulsion for use in the silver halide photographic material of the present invention is silver chlorobromide or silver iodochlorobromide having a silver chloride content of 50 mol % or more. A silver iodide content is preferably 3 mol % or less, and more preferably 0.5 mol % or less. The form of the silver halide grains may be cubic, tetradecahedral, octahedral, irregular or tabular form, but cubic form is preferred. The average grain size of the silver halide grains is preferably from 0.1 μm to 0.7 μm, and more preferably from 0.2 μm to 0.5 μm. With respect to the grain size distribution, grains which have a narrow grain size distribution such that the variation coefficient represented by the equation [(standard deviation of the grain size)/(average grain size)]×100 is preferably 15% or less, more preferably 10% or less, are preferred.

The interior and the surface layer of the silver halide grains may comprise a uniform phase or different phases.

The photographic emulsions which are used in the present invention can be prepared according to the methods disclosed in P. Glafkides, *Chimie et Physique Photographique,* Paul Montel, 1967, G. F. Duffin, *Photographic Emulsion Chemistry,* The Focal Press, 1966, and V. L. Zelikman et al., *Making and Coating Photographic Emulsion,* The Focal Press, 1964.

A single jet method, a double jet method or a combination of these methods may be used for reacting a soluble silver salt with a soluble halogen salt.

A method in which grains are formed in the presence of excess silver ion (a so-called reverse mixing method) can also be used. A method in which the pAg in the liquid phase in which the silver halide is formed is kept constant, that is, the controlled double jet method, can also be used as one type of the double jet method. In addition, the grain formation of the present invention is preferably carried out using silver halide solvents such as ammonia, thioether, or 4-substituted thiourea. More preferred are 4-substituted thiourea compounds and they are disclosed in JP-A-53-82408 and JP-A-55-77737. Preferred thiourea compounds are tetramethylthiourea and 1,3-dimethyl-2-imidazolidinethione.

Silver halide emulsions with a regular crystal form and a narrow grain size distribution can easily be obtained using the controlled double jet method and silver halide solvents, which is effective to prepare the silver halide emulsion for use in the present invention.

Moreover, the method in which the rate of addition of the silver nitrate and the alkali halide is varied according to the grain growth rate as disclosed in British Patent 1,535,016, JP-B-48-36890 and JP-B-52-16364, and the method in which the concentrations of the aqueous solutions are varied as disclosed in British Patent 4,242,445 and JP-A-55-158124 are preferably and effectively used to rapidly grow grains within the range not exceeding the critical degree of saturation in order to provide uniform grain size.

It is preferred to contain rhodium compounds in the silver halide photographic material of the present invention to attain high contrast and low fog generation.

Water-soluble rhodium compounds can be used as a rhodium compound in the present invention, for example, rhodium(III) halide compounds, or rhodium complex salts having halogen, amines, or oxalate as a ligand, such as hexachlororhodium(III) complex salts, hexabromorhodium (III) complex salts, hexaamminerhodium(III) complex salts, and trioxalatorhodium(III) complex salts. These rhodium compounds are dissolved in water or an appropriate solvent and used. Conventional methods such as a method in which an aqueous solution of hydrogen halide (e.g., hydrochloric acid, hydrobromic acid, hydrofluoric acid) or alkali halide (e.g., KCl, NaCl, KBr, NaBr) are added to stabilize the solution of rhdoium compound can be used. It is also possible to include and dissolve another silver halide grains which have been previously doped with rhodium during the preparation of silver halide instead of using water-soluble rhodium.

The total addition amount of the rhodium compounds for use in the present invention is appropriately from $1\times10^{-8}$ to $5\times10^{-6}$ mol, and preferably from $5\times10^{-8}$ to $1\times10^{-6}$ mol, per mol of the silver halide finally formed.

These compounds can be added optionally during the preparation of the silver halide emulsion grains and at any stage prior to coating of the emulsion, but they are preferably added during the emulsion formation and taken up into the silver halide grains.

It is preferred to contain iridium compounds in the silver halide photographic material of the present invention to attain high sensitivity and high contrast.

Various iridium compounds can be used in the present invention, for example, hexachloroiridium, hexaammineiridium, trioxalatoiridium, hexacyanoiridium. These iridium compounds are dissolved in water or an appropriate solvent and used. Conventional methods such as a method in which an aqueous solution of hydrogen halide (e.g., hydrochloric acid, hydrobromic acid, hydrofluoric acid) or alkali halide (e.g., KCl, NaCl, KBr, NaBr) are added to stabilize the solution of iridium compound can be used. It is also possible to include and dissolve another silver halide grains which have been previously doped with iridium during the preparation of silver halide instead of using water-soluble iridium.

The total addition amount of the iridium compounds for use in the present invention is appropriately from $1\times10^{-8}$ to $5\times10^{-6}$ mol, and preferably from $5\times10^{-8}$ to $1\times10^{-6}$ mol, per mol of the silver halide finally formed.

These compounds can be added optionally during the preparation of the silver halide emulsion grains and at any stage prior to coating of the emulsion, but they are preferably added during the emulsion formation and taken up into the silver halide grains.

The silver halide grains for use in the present invention may contain metal atoms such as iron, cobalt, nickel, ruthenium, palladium, platinum, gold, thallium, copper, lead, or osmium. The preferred addition amount of these metals is $1\times10^{-9}$ to $1\times10^{-4}$ mol per mol of silver halide. Further, these metals can be added as a metal salt in the form of a salt, a double salt or a complex salt during the preparation of the grains.

The silver halide emulsion of the present invention is preferably chemically sensitized. Conventionally known chemical sensitization methods such as sulfur sensitization, selenium sensitization, tellurium sensitization and noble metal sensitization can be used alone or in combination. When combined use is employed, for example, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually carried out by adding a sulfur sensitizer and stirring the emulsion at high temperature of 40° C. or more for a certain period of time. Various known compounds can be used as a sulfur sensitizer, for example, various sulfur compounds, e.g., thiosulfates, thioureas, thiazoles, and rhodanines, in addition to sulfur compounds contained in gelatin. Preferred sulfur compounds are thiosulfate and thiourea. The addition amount of the sulfur sensitizer is varied in accordance with various conditions such as the pH and temperature during the chemical ripening and the grain size of the silver halide, but preferably from $10^{-7}$ to $10^{-2}$ mol and more preferably from $10^{-5}$ to $10^{-3}$ mol, per mol of the silver halide.

Various known selenium compounds can be used as a selenium sensitizer in the present invention. The selenium sensitization is usually carried out by adding unstable and/or non-unstable selenium compounds and stirring the emulsion at high temperature of 40° C. or more for a certain period of time. The compounds disclosed in JP-B-44-15748, JP-B-43-13489, JP-A-4-109240, and JP-A-4-324855 can be used as unstable selenium compounds. The compounds disclosed in JP-A-4-324855, represented by formulae (VIII) and (IX) are particularly preferably used.

The tellurium sensitizer for use in the present invention is a compound which forms silver telluride in the surface or interior of the silver halide grains which is presumed to become a sensitization nucleus. The formation rate of the silver telluride in the silver halide emulsion can be examined according to the method disclosed in JP-A-5-313284.

Specifically, the compounds disclosed in the following patents and literature can be used as tellurium sensitizers: U.S. Pat. Nos. 1,623,499, 3,320,069, 3,772,031, British Patents 235,211, 1,121,496, 1,295,462, 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai, *The Chemistry of Organic Selenium and Tellurium Compounds*, Vol. 1 (1986), and ibid., Vol. 2 (1987). The compounds disclosed in JP-A-5-313284, represented by formulae (II), (III) and (IV) are particularly preferred.

The amount to be used of the selenium and tellurium sensitizers in the present invention varies according to the silver halide grains used and the conditions of chemical ripening, but is generally about $10^{-8}$ to $10^{-2}$ mol and preferably about $10^{-7}$ to $10^{-3}$ mol. There is no particular limitation on the conditions of chemical sensitization in the present invention, but pH is from 5 to 8, pAg is from 6 to 11, preferably from 7 to 10, and temperature is from 40 to 95° C., preferably from 45° to 85° C. Specific examples of the compounds are shown below.

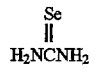
S-1

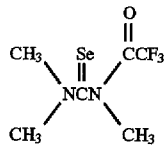
S-2

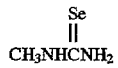
S-3

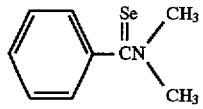
S-4

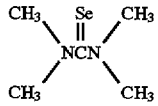
S-5

S-6

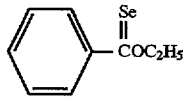
S-7

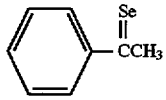
S-8

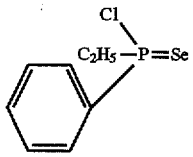
S-9

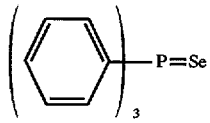
S-10

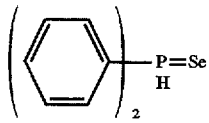
S-11

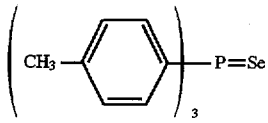
S-12

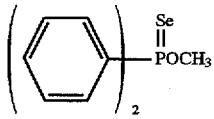
S-13

$(nC_4H_9)_3P{=}Se$ S-14

-continued
S-15
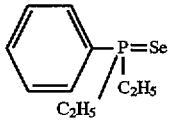
S-16
$(C_2H_5O)_3P{=}Se$
S-17
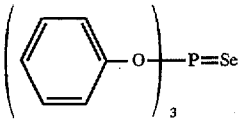
S-18
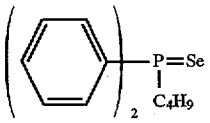
S-19
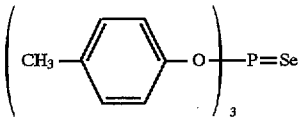
S-20
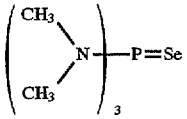
$(nC_4H_9)_3P{=}Te$ T-1.
$(tC_4H_9)_3P{=}Te$ T-2.
T-3.
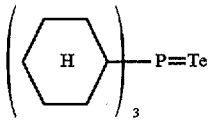
$((i)C_3H_7)_3P{=}Te$ T-4.
T-5.
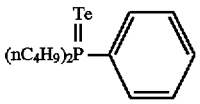
T-6.
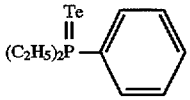
$((i)C_4H_9)_3P{=}Te$ T-7.
T-8.
$((i)C_4H_9)_2P(Te)C_4H_9(n)$
T-9.
$(i)C_3H_7P(C_4H_9(n))_2(Te)$
T-10.
$((i)C_3H_7)_2P(Te)C_4H_9(n)$
T-11.
$(i)C_3H_7P(C_4H_9(i))_2(Te)$
T-12.
$((i)C_3H_7)_2P(Te)C_4H_9(i)$
-continued
T-13.
$((i)C_3H_7)_2P(Te)C_8H_{17}(n)$
T-14.
$C_2H_5P(Te)(OC_2H_5)_2$
T-15.
$(n\text{-}C_4H_9O)_3P{=}Te$
T-16.
$C_2H_5P(Te)(N(CH_3)_2)_2$
T-17.
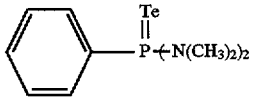
$((CH_3)_2N)_3P{=}Te$ T-18.
T-19.
$((CH_3)_3SiO)_2P(Te)H$
T-20.
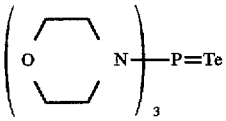
T-21.
$(C_2H_5)_2P(Te)N(C_2H_5)_2$
T-22.
$H_2P(Te)NH_2$
T-23.
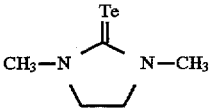
T-24.
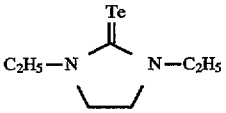
T-25.
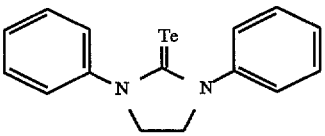
T-26.
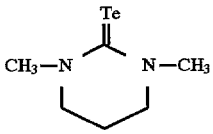
T-27.
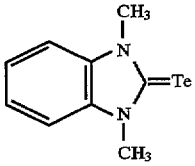
T-28.
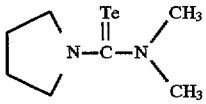

-continued

T-29.

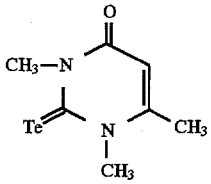

T-30.

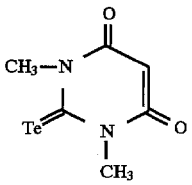

T-31

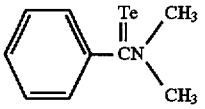

T-32.

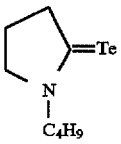

T-33

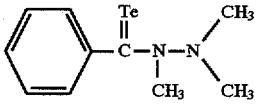

T-34.

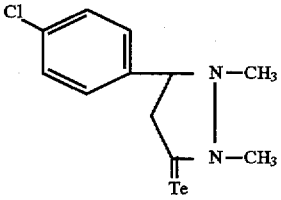

T-35.

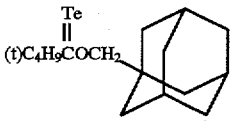

The noble metal sensitizers which are used in the present invention include gold, platinum, palladium and iridium, and gold sensitization is particularly preferred. Specific examples of the gold sensitizers for use in the present invention include chloroauric acid, potassium chlorate, potassium aurithiocyanate and gold sulfide, and the amount of about $10^{-7}$ to $10^{-2}$ mol per mol of silver halide can be used.

Cadmium salt, sulfite, lead salt and thallium salt may be coexist in the silver halide emulsion of the present invention in the process for the formation or physical ripening of silver halide grains.

Reduction sensitization can be used in the present invention. As reduction sensitizers there may be used stannous salt, amines, formamidinesulfinic acid, and silane compounds.

Thiosulfonic acid compounds may be added to the silver halide emulsion of the present invention according to the method disclosed in EP 293,917.

The silver halide emulsion in the photographic material of the present invention may be one kind, or two or more kinds of silver halide emulsions (for example, those differing in average grain sizes, differing in halogen compositions, differing in crystal habits, differing in the conditions of chemical sensitization) may be used in combination.

The polymer latexes represented by formula (I) of the present invention may be contained in any hydrophilic colloid layers, e.g., a silver halide emulsion layer, a protective layer, an interlayer, a subbing layer and a backing layer, but preferably contained in hydrophilic colloid layers of the emulsion layer side of the support, particularly an emulsion layer. There is no limitation on the amount to be used but is preferably from 5 wt % to 70 wt %, and particularly preferably from 20 wt % to 50 wt %, based on gelatin in the layer to be added.

The combination of silver halide emulsion and polymer latex of the present invention is particularly suitable for superhigh contrast silver halide photographic materials using hydrazine derivatives as a nucleating agent.

The hydrazine derivative for use in the present invention is a compound represented by formula (II):

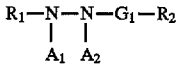

(II)

In formula (II), the aliphatic group represented by $R_1$ preferably has from 1 to 30 carbon atoms, and is particularly preferably a straight chain, branched or cyclic alkyl group having from 1 to 20 carbon atoms. Herein, the branched alkyl group may be cyclized to form a saturated heterocyclic ring containing one or more hetero atoms. Further, this alkyl groups may be substituted.

The aromatic group represented by $R_1$ in formula (II) is a monocyclic or bicyclic aryl group or an unsaturated heterocyclic group. Here, the unsaturated heterocyclic group may be condensed with a monocyclic or bicyclic aryl group to form a heteroaryl group, for example, a benzene ring, a naphthalene ring, a pyridine ring, pyrimidine ring, an imidazole ring, a pyrazole ring, a quinoline ring, an isoquinoline ring, a benzimidazole ring, a thiazole ring, and a benzothiazole ring, and those containing a benzene ring are preferred of them.

$R_1$ is particularly preferably an aryl group.

The aliphatic group or aromatic group of $R_1$ may be substituted, and representative substituents include, for example, an alkyl group, an alkenyl group, an alkynyl group, an aryl group, a group containing a heterocyclic ring, a pyridinium group, a hydroxyl group, an alkoxy group, an aryloxy group, an acyloxy group, an alkyl- or arylsulfonyloxy group, an amino group, a carbonamide group, a sulfonamide group, a ureido group, a thioureido group, a semicarbazide group, a thiosemicarbazide group, a urethane group, a group having a hydrazide structure, a group having a quaternary ammonium structure, an alkyl- or arylthio group, an alkyl- or arylsulfonyl group, an alkyl- or arylsulfinyl group, a carboxyl group, a sulfo group, an acyl group, an alkoxy- or aryloxycarbonyl group, a carbamoyl group, a sulfamoyl group, a halogen atom, a cyano group, a phosphonamide group, a diacylamino group, an imide group, a group having an acylurea structure, a group containing a selenium atom or a tellurium atom, and a group having a tertiary or quaternary sulfonium structure, and preferred substituents include a straight chain, branched or cyclic alkyl group (preferably having from 1 to 20 carbon atoms), an aralkyl group (preferably monocyclic or bicyclic and the alkyl moiety of which has from 1 to 3 carbon atoms), an alkoxy group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamide group (preferably having from 1 to 30 carbon atoms), a ureido group (preferably having from 1 to 30 carbon atoms), and a phosphonamide group (preferably having from 1 to 30 carbon atoms).

The alkyl group represented by $R_2$ in formula (II) is preferably an alkyl group having from 1 to 4 carbon atoms, and the aryl group represented by $R_2$ in formula (II) is preferably a monocyclic or bicyclic aryl group, for example, an aryl group which contains a benzene ring.

The unsaturated heterocyclic group is a 5- or 6-membered compound containing at least one nitrogen, oxygen or sulfur atom, for example, an imidazolyl group, a pyrazolyl group, a triazolyl group, a tetrazolyl group, a pyridyl group, a pyridinium group, a quinolinium group or a quinolyl group. A pyridyl group and a pyridinium group are particularly preferred.

An alkoxy group having from 1 to 8 carbon atoms is preferred as an alkoxy group, a monocyclic aryloxy group is preferred as an aryloxy group, an unsubstituted amino group, an alkylamino group having from 1 to 10 carbon atoms and an arylamino group are preferred as an amino group.

$R_2$ may be substituted, and groups cited as substituents for $R_1$ are applied to $R_2$ as preferred substituents.

Preferred groups of the groups represented by $R_2$ are, when $G_1$ represents a —CO— group, a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), and an aryl group (e.g., phenyl, 3,5-dichlorophenyl, o-methanesulfonamidophenyl, 4-methanesulfonylphenyl, 2-hydroxymethylphenyl), and a hydrogen atom and a trifluoromethyl group are particularly preferred of them.

Further, when $G_1$ represents an —$SO_2$— group, preferred groups represented by $R_2$ are an alkyl group (e.g., methyl), an aralkyl group (e.g., o-hydroxybenzyl), an aryl group (e.g., phenyl), and a substituted amino group (e.g., dimethylamino).

When $G_1$ represents a —COCO— group, $R_2$ preferably represents an alkoxy group, an aryloxy group, or an amino group.

$G_1$ in formula (II) preferably represents —CO— and —COCO—, and most preferably —CO—.

Further, $R_2$ may be a group such that the —$G_1$—$R_2$ moiety is cleaved from the remainder of the molecule and a cyclization reaction occurs to form a ring structure in which the atoms of the —$G_1$—$R_2$ moiety is contained, and the example thereof is disclosed in JP-A-63-29751.

$A_1$ and $A_2$ in formula (II) each represents a hydrogen atom, an alkyl-or arylsulfonyl group having 20 or less carbon atoms (preferably phenylsulfonyl or substituted phenylsulfonyl having the sum of the Hammet substituent constant of −0.5 or more), an acyl group having 20 or less carbon atoms (preferably benzoyl or substituted benzoyl having the sum of the Hammet substituent constant of −0.5 or more, or straight chain, branched or cyclic, substituted or unsubstituted aliphatic acyl (substituents include, e.g., halogen, ether, sulfonamide, carbonamide, hydroxyl, carboxyl, sulfonic acid)).

$A_1$ and $A_2$ most preferably represent a hydrogen atom.

The substituents represented by $R_1$ and $R_2$ in formula (II) may further be substituted and preferred substituents include those cited as the substituents for $R_1$. Substituent may be substituted multiple times, that is, further substituent, substituent of the substituent, substituent of the substituent of the substituent . . . , and preferred substituents are also those cited as substituents for $R_1$.

$R_1$ or $R_2$ in formula (II) may include a ballast group or a polymer which are normally used in immobile photographic additives such as couplers. Such a ballast group has 8 or more carbon atoms and is a group which is photographically comparatively inactive and can be selected from, for example, an alkyl group, an aralkyl group, an alkoxy group, a phenyl group, an alkylphenyl group, a phenoxy group and an alkylphenoxy group. Further, those disclosed in JP-A-1-100530 can be cited as such a polymer, for example.

$R_1$ or $R_2$ in formula (II) may include a group which is strong adsorbed onto the surface of silver halide grains. Examples of such an adsorptive group include an alkylthio group, an arylthio group, a thiourea group, a heterocyclic thioamide group, a mercapto heterocyclic group, and a triazole group as disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

The particularly preferred hydrazine derivative for use in the present invention is a hydrazine derivative in which $R_1$ represents a group which accelerates adsorption onto a ballast group and the surface of silver halide grains via a sulfonamide group, an acylamino group or a ureido group, a group having a quaternary ammonium structure, or a phenyl group having an alkylthio group, $G_1$ represents a —CO— group, and $R_2$ represents a hydrogen atom, a substituted alkyl group, or a substituted aryl group (preferred substituents include an electron attractive group or a 2-hydroxymethyl group). In addition, any combinations of the selection from the above $R_1$ and $R_2$ are possible and preferred.

Specific examples of the compounds represented by formula (II) are shown below, but the present invention is not limited thereto.

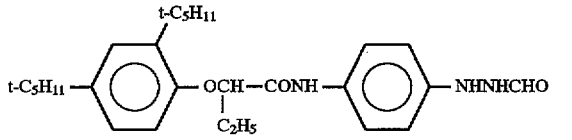

III-1

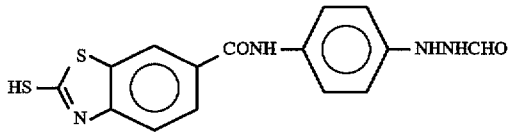

III-2

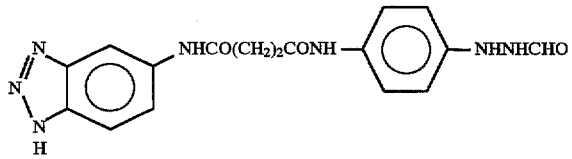

III-3

-continued
III-4
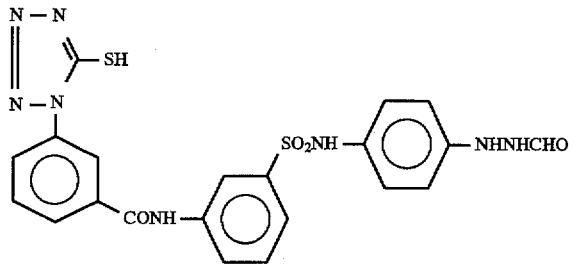
III-5
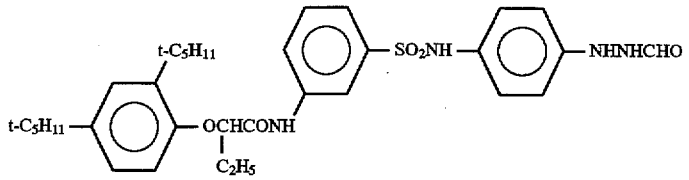
III-6
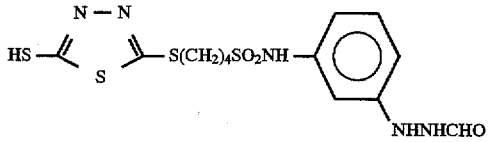
III-7
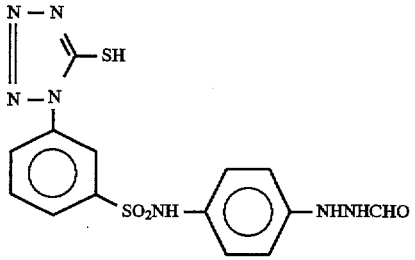
III-8
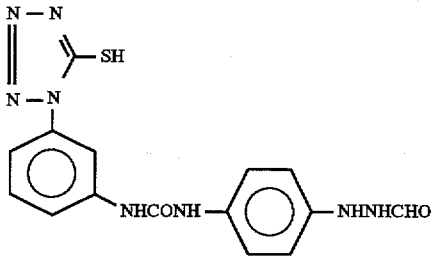
III-9
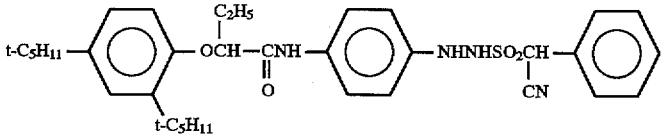
III-10
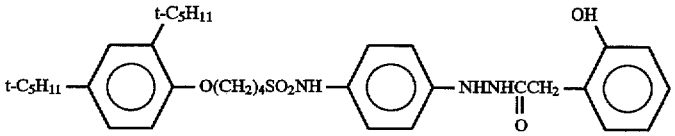
III-11
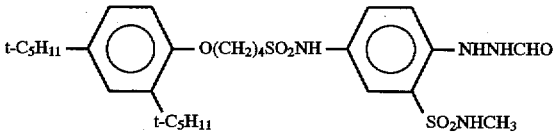

-continued
III-12
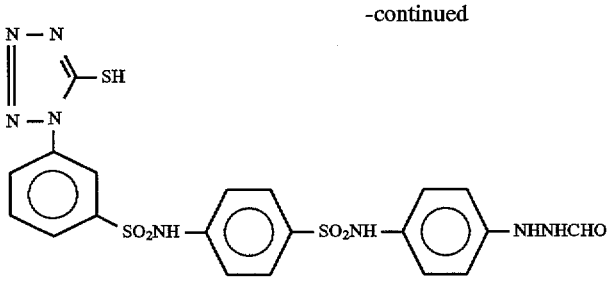
III-13
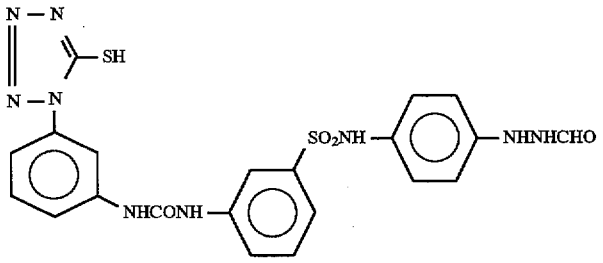
III-14
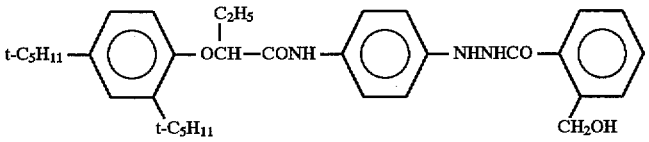
III-15
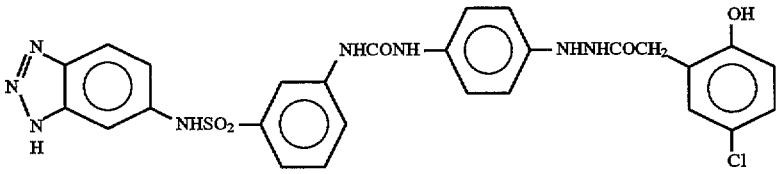
III-16
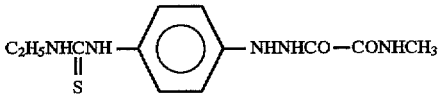
III-17
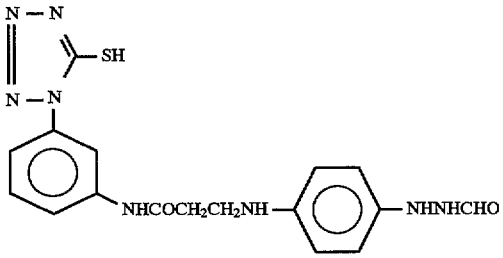
III-18
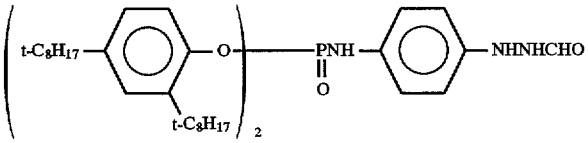
III-19
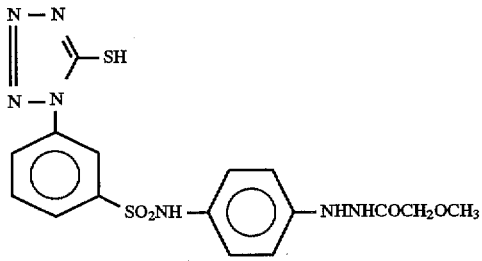

-continued
III-20
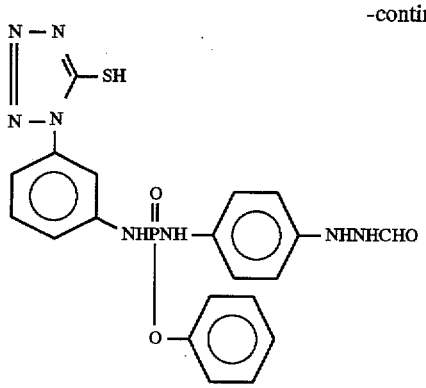
III-21
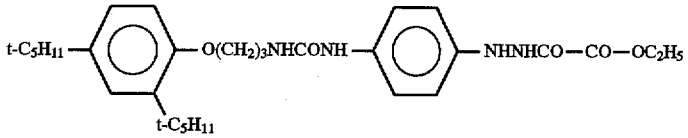
III-22
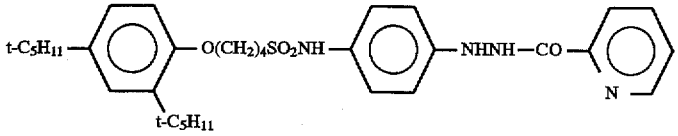
III-23
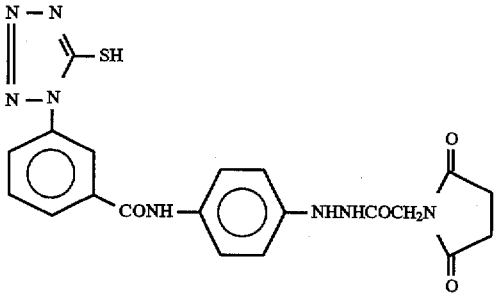
III-24
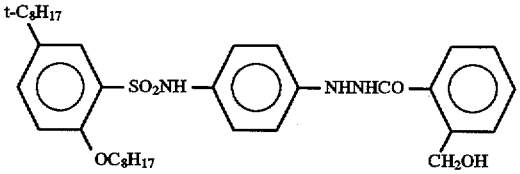
III-25
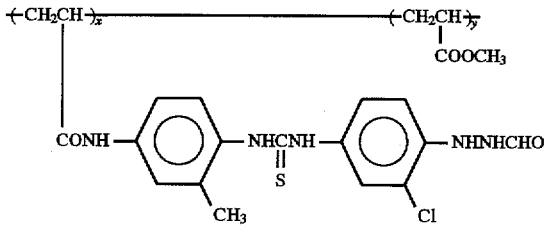
x/y = 3/97
average molecular weight = 100,000
III-26
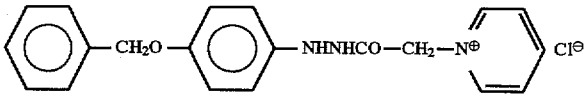
III-27
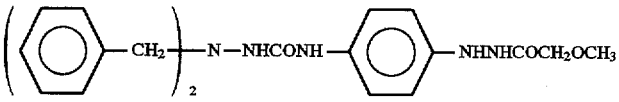

-continued
III-28
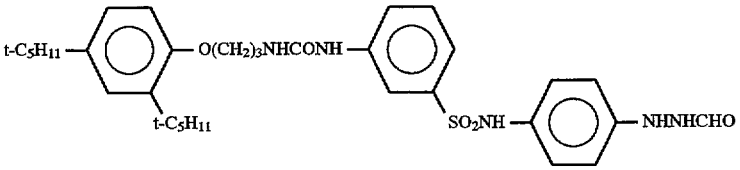
III-29
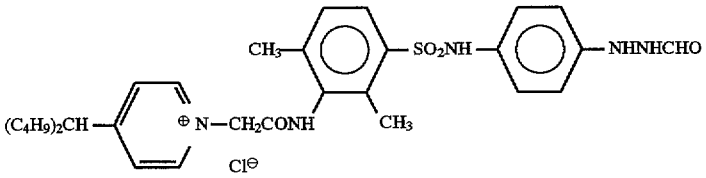
III-30
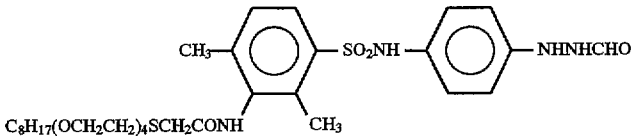
III-31
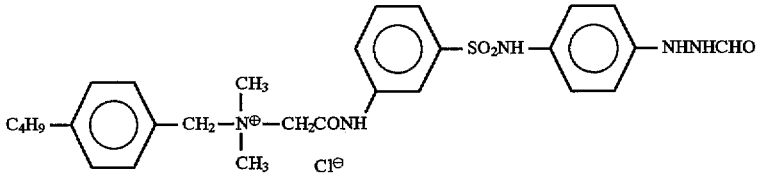
III-32
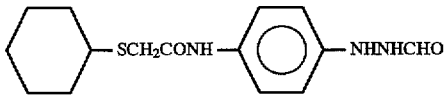
III-33
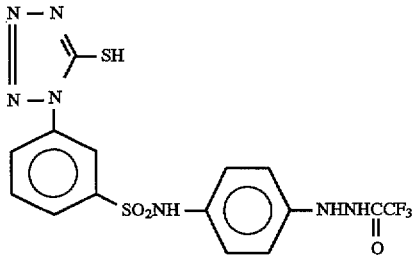
III-34
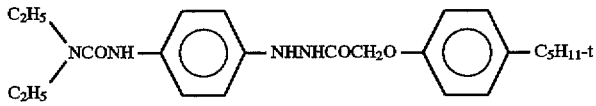
III-35
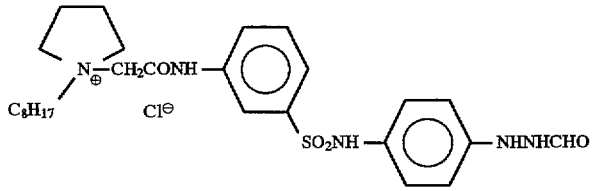
III-36
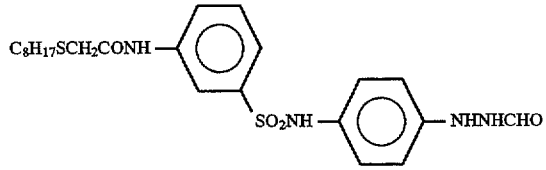

-continued
III-37
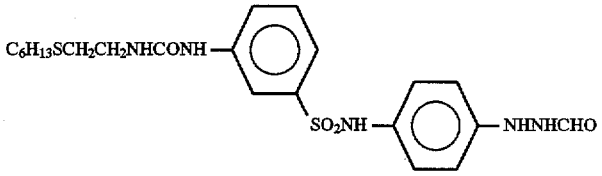
III-38
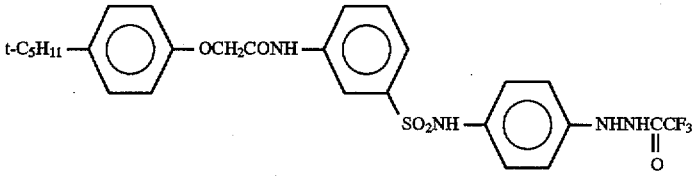
III-39
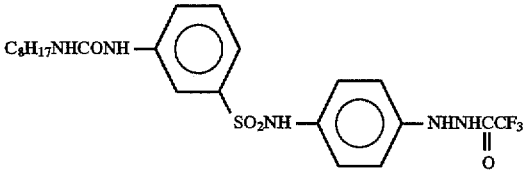
III-40
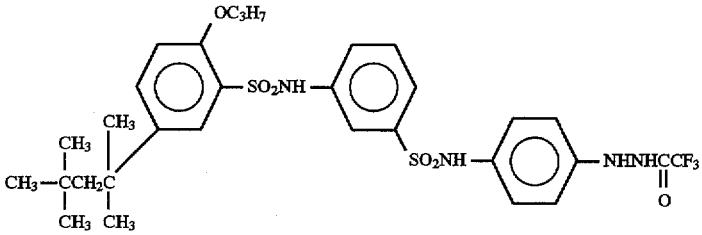
III-41
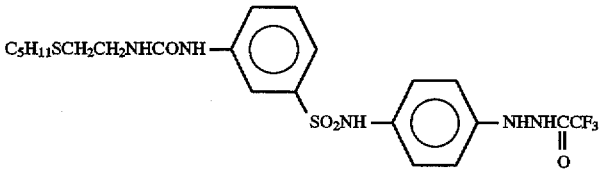
III-42
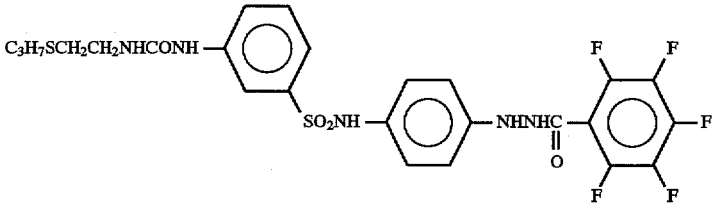
III-43
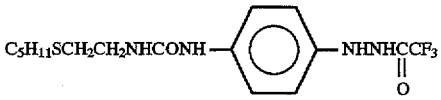
III-44
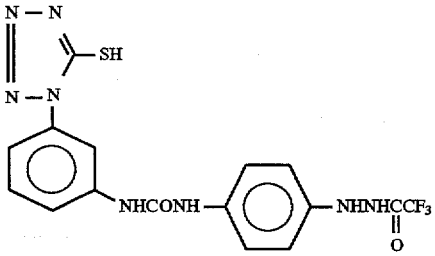

-continued
III-45
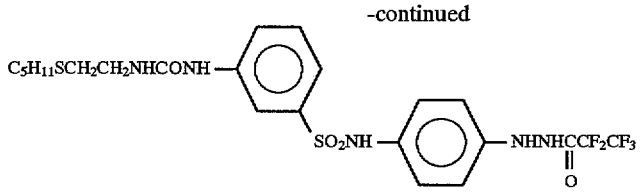
III-46
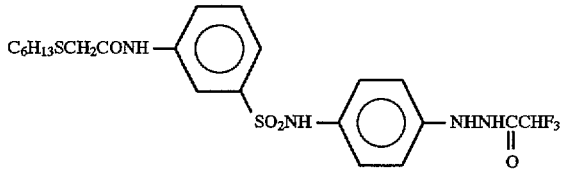
III-47
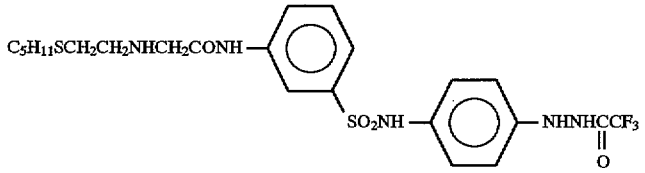
III-48
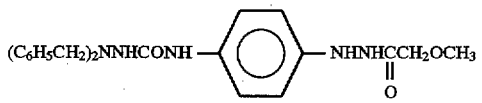
III-49
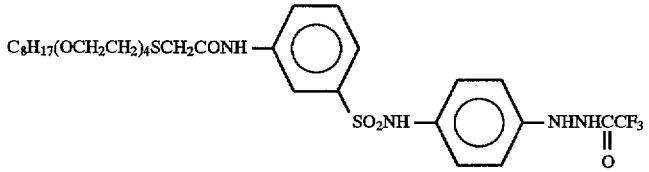
III-50
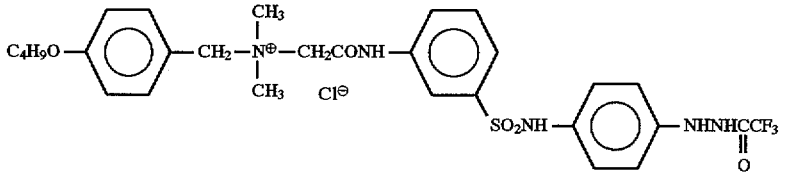
III-51
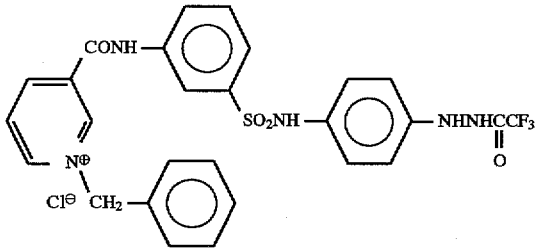
III-52
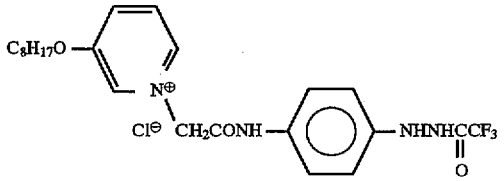
In addition to the compounds shown above, the hydrazine derivatives disclosed in *Research Disclosure,* No. 23516 (November, 1983, p. 346) and the literature cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, 5,104,769, British Patent 2,011,391B, EP 217,310, EP 301,799, EP 356,898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-

196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765, and Japanese Patent Application No. 5-94925 can be used as hydrazine derivatives in the present invention.

The amount of hydrazine derivatives used in the present invention is preferably from $1\times10^{-6}$ mol to $5\times10^{-2}$ mol, and particularly preferably from $1\times10^{-5}$ mol to $2\times10^{-2}$ mol, per mol of silver halide.

The hydrazine derivatives of the preent invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the hydrazine derivatives of the preent invention can also be used in the form of an emulsion dispersion mechanically prepared according to well known emulsifying dispersion methods by dissolving using oils such as dibutyl phthalate, tricresyl phosphate, glyceryl triacetate and diethyl phthalate, or auxiliary solvents such as ethyl acetate and cyclohexanone, or they can be used in the form of a dispersion prepared according to a method known as a solid dispersion method in which powders of hydrazine derivatives are dispersed in water using a ball mill, a colloid mill or ultrasonic wave.

There is no particular limitation on the amount used of gelatin which is used as a binder or a protective colloid for the photographic emulsion, but the weight ratio of gelatin/silver in the emulsion layer is preferably 0.5 or less and particularly preferably from 0.5 to 0.1.

The photographic material of the present invention exhibits excellent effect by rapid development processing of the total processing time of from 15 sec to 60 sec, or by the automatic processor of line speed of 1,000 mm/min or more.

The temperature and time of the development and fixing in rapid processing of the present invention is generally from about 25° C. to 50° C. for 25 seconds or less, respectively, and preferably from 30° C. to 40° C. for from 4 seconds to 15 seconds.

There is no limitation on the support of the silver halide photographic material of the present invention and those which are usually used in the art can be used.

For example, glass, a cellulose acetate film, a polyethylene terephthalate film, paper, baryta coated paper, polyolefin (e.g., polyethylene, polypropylene) laminated paper, a polystyrene film, a polycarbonate film, a metal plate such as aluminum can be used as a support in the present invention.

These supports may be subjected to a corona treatment by conventional methods or may be undercoat processed, if necessary.

There is no particular limitation on various additives for use in the present invention and development processing method of the photographic material of the present invention and, for example, those described in the following corresponding places can preferably be used.

| Item | Places |
|---|---|
| (1) Silver halide emulsion and the preparation method | line 12, right lower column, page 20 to line 14, left lower column, page 21 of JP-A-2-97937; and line 19, right upper column, page 7 to line 12, rght lower column, page 8 of JP-A-2-12236 |
| (2) Spectral sensitizing dye | line 8, left upper column, page 7 to line 8, right lower column, page 8 of JP-A-2-55349 |
| (3) Surfactant and antistatic agent | line 7, right upper column, page 9 to line 7, right lower column, page 9 to JP-A-2-12236; and line 13, left lower column, page 2 to line 18, right lower column, page 4 of JP-A-2-18542 |
| (4) Antifoggant and stabilizer | line 19, right lower column, page 17 to line 4, right upper column, page 18 of JP-A-2-103526; and lines 1 to 5, right lower column, page 18 of JP-A-2-103526 |
| (5) Polymer latex | lines 12 to 20, left lower column, page 18 of JP-A-2-103526 |
| (6) Compound having acid radical | line 6, right lower column, page 18 to line 1, left lower column, page 19 of JP-A-2-103526; and line 13, right lower column, page 8 to line 8, left upper column, page 11 of JP-A-2-55349 |
| (7) Polyhydroxybenzenes | line 9, left upper column, page 11 to line 17, right lower column, page 11 of JP-A-2-55349 |
| (8) Matting agent, sliding agent and plasticizer | line 15, left upper column, page 19 to line 15, right upper column, page 19 of JA-A-2-103526 |
| (9) Hardening agent | lines 5 to 17, right upper column, page 18 of JP-A-2-103636 |
| (10) Dye | lines 1 to 18, right lower column, page 17 of JP-A-2-103536 |
| (11) Binder | line 1 to 20, right lower column, page 3 of JP-A-2-18542 |
| (12) Hydrazine nucleating agent | line 19, right upper column, page 2 to line 3, right upper column, page 7 of JP-A-2-12236; and formula (II) and Compounds II-1 to II-54 in line 1, right lower column, page 20 to line 20, right upper column, page 27 of JP-A-3-174143 |
| (13) Nucleation accelerating agent | formulae (II-m) to (II-p) and Compounds II-1 to II-22 in line 13, right upper column, page 9 to line 10, left upper column, page 16 of JP-A-2-103536; and JP-A-1-179939 |
| (14) Developing solution and developing method | line 1, right lower column, page 13 to line 10, left upper column, page 16 of JP-A-2-55349 |

The present invention is applicable to various silver halide photographic materials such as materials for printing, for microfilms, for medical X-ray, for industrial X-ray, general negative photographic materials, and general reversal photographic materials.

EXAMPLE

The present invention is described in detail with reference to the examples, but it should not be construed as being limited thereto.

Example 1

Preparation of Emulsion A

| Solution 1 | |
|---|---|
| Water | 1 liter |
| Gelatin | 20 g |
| Sodium Chloride | 4.0 g |
| 1,3-Dimethylimidazolidine-2-thione | 30 mg |
| Sodium Benzenesulfonate | 6 mg |
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Hexachlororhodium(III) Potassium Salt (0.001% aq. soln.) | 5 ml |

Solution 2 and Solution 3 were simultaneously added over a period of 15 minutes, with stirring, to Solution 1 which was maintained at 40° C., pH 4.5, and nuclear grains having a grain size of 0.20 μm were formed. Subsequently, Solution 4 and Solution 5 shown below were added over a period of 15 minutes. Further, 0.15 g of potassium iodide was added and grain formation was terminated.

| Solution 4 | |
|---|---|
| Water | 400 ml |
| Silver Nitrate | 100 g |
| Solution 5 | |
| Water | 400 ml |
| Sodium Chloride | 27.1 g |
| Potassium Bromide | 21.0 g |
| Hexacyanoiron(II) Potassium Salt (0.1% aq. soln.) | 15 ml |

Subsequently, the reaction product obtained was washed with water according to an ordinary flocculation method, and 30 g of gelatin was added.

After adjusting the pH to 5.5 and the pAg to 7.5, 3.7 mg of sodium thiosulfate and 6.2 mg of chloroauric acid were added and chemical sensitization was conducted at 65° C. as to provide optimal sensitivity.

Further, 200 mg of 4-hydroxy-6-methyl-1,3,3a,7-tetraazaindene as a stabilizer and phenoxyethanol as a preservative were added, and finally Emulsion A of cubic silver chloroiodobromide having an average grain size of 0.25 μm and a silver chloride content of 70 mol % was obtained.

Preparation of Emulsion B

Emulsion B was prepared in the same manner as the preparation of Emulsion A except that chemical sensitization conditions were changed as follows: pH: 5.9, pAg: 7.5, temperature: 65° C., sodium thiosulfate: 2.0 mg, triphosphine selenide: 3.0 mg, chloroauric acid: 6 mg, sodium benzenethiosulfonate: 4 mg, sodium benzenesulfinate: 1 mg.

Preparation of Emulsion C

Emulsion C was prepared in the same manner as the preparation of Emulsion B except for changing the silver chloride content to 30 mol %.

Preparation of Emulsion D

Emulsion D was prepared in the same manner as the preparation of Emulsion B except for changing the silver chloride content to 100 mol %.

The characteristics of Emulsions A to D were indicated in Table 1.

Preparation of Coated Samples

The sensitizing dye shown bellow was added to the above emulsions in an amount of $5\times10^{-4}$ mol per mol of silver and spectral sensitization was carried out. Further, 1.5 g, 50 mg, per mol of silver, respectively, of 1-phenyl-5-mercaptotetrazole as an antifoggant, 40%, with respect to the gelatin binder, of colloidal silica having a particle size of 10 mμ, and polymer latex in the amounts shown in Table 2 were added to the above emulsions. Further, 2-bis (vinylsulfonyl-acetamide)ethane was added as a hardening agent, and the emulsions were coated on polyester supports so as to provide a coated silver weight of 3.4 g/m$^2$ and a coated gelatin weight of 1.5 g/m$^2$.

Sensitizing Dye

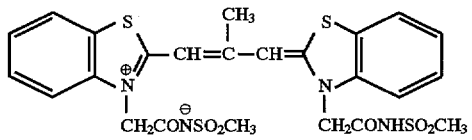

On the emulsion layers were coated, as upper protective layers, 0.5 g/m$^2$ of gelatin, 40 mg/m$^2$ of an amorphous $SiO_2$ matting agent having an average particle size of about 3.5 μm, 50 mg/m$^2$ of silicone oil, 80 mg/m$^2$ of colloidal silica, and 5 mg/m$^2$ of fluorine surfactant having the structural formula (f) shown below and 100 mg/m$^2$ of sodium dodecylbenzenesulfonate, both as coating aids, and as lower protective layers, 0.8 g of gelatin, 400 mg/m$^2$ of ethyl acrylate latex and 200 mg/m$^2$ of hydroquinone, and thus samples as indicated in Table 1 were obtained.

Further, a backing layer and a backing protective layer having the formulations shown below were coated.

(f)

$C_8F_{17}SO_2N(C_3H_7)CH_2COOK$

Formulation of Backing Layer

| | |
|---|---|
| Gelatin | 3 g/m² |
| Polyethyl Acrylate (latex) | 2 g/m² |
| Sodium p-Dodecylbenzenesulfonate (surfactant) | 40 mg/m² |
| $(CH_2{=}CHSO_2CH_2CONH)_2CH_2$ | 110 mg/m² |
| $SnO_2$/Sb (weight ratio: 90/10, (average grain size: 0.20 μm) | 200 mg/m² |
| Dye (mixture of Dye (a), Dye (b) and Dye (c)): | |
| Dye (a) 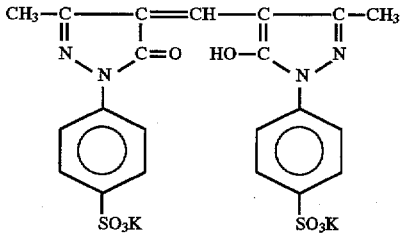 | 50 mg/m² |
| Dye (b) 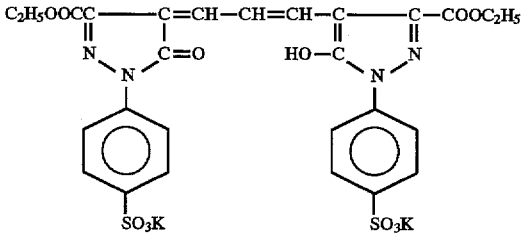 | 100 mg/m² |
| Dye (c) 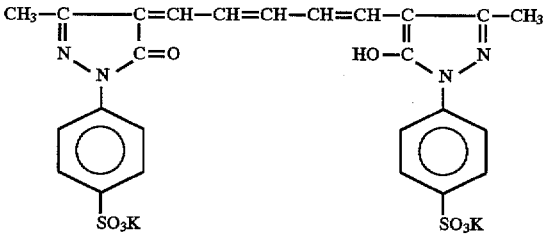 | 50 mg/m² |

Backing Protective Layer

| | |
|---|---|
| Gelatin | 0.8 mg/m² |
| Fine Particles of Polymethyl Methacrylate (average particle size: 4.5 μm) | 30 mg/m² |
| Sodium Dihexyl-α-sulfosuccinate | 15 mg/m² |
| Sodium p-Dodecylbenzenesulfonate | 15 mg/m² |
| Sodium Acetate | 40 mg/m² |

Evaluation was conducted in the following manner.

Photographic Characteristics

The thus obtained samples were exposed with a tungsten light through a step wedge, then processed at 38° C. for 20 seconds using Developing Solution 1 having the composition shown below and fixing solution GR-F1 (manufactured by Fuji Photo Film Co., Ltd.) using an automatic processor FG-680AG (manufactured by Fuji Photo Film Co., Ltd.). The results of the evaluation were shown in Table 2.

Here, the reciprocal of the exposure amount providing a density of 1.5 in the development at 38° C. for 20 seconds was taken as the sensitivity and is expressed by a relative value. Gamma (γ) is expressed by the following equation.

$$\gamma=(3.0-0.3)/\log(\text{exposure amount providing a density of } 0.3)-$$

log(exposure amount providing a density of 3.0)

Pressure Characteristics

Evaluation of pressure fog was carried out such that the surface of the samples was rubbed with a sapphire needle having a diameter of 0.1 mm under a load of from 0 to 200 g under conditions of 25° C. and 60% RH, then the samples were development processed according to the above development processing conditions and the load under which pressure fog occurred was measured.

Preservability

After the samples were allowed to stand for 20 days under 55% humidity at 40° C., sensitometry was carried out according to conditions described above at photographic characteristics and evaluation was conducted.

TABLE 1

| Emulsion | Chemical Sensitization | Halogen Composition |
|---|---|---|
| A | S + Au | $AgBr_{0.3}Cl_{0.7}$ |
| B | Se + Au | " |
| C | " | $AgBr_{0.7}Cl_{0.3}$ |
| D | " | AgCl |

S: Sulfur sensitization
Au: Gold sensitization
Se: Selenium sensitization

-continued

| | |
|---|---|
| Sodium 2-Mercaptobenzimidazole-5-sulfonate | 0.15 g |
| Water to make | 1 liter |
| (potassium hydroxide was added to adjust pH to 10.5) | |

Example 2

Samples were prepared in the same manner as in Example 1 except that the hydrazine derivatives of the present invention were added as indicated in Table 3 and 10 mg/m$^2$ of the following nucleation accelerating agent was added during the formation of coating samples.

Nucleation Accelerating Agent

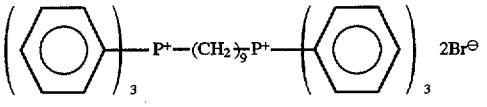

Evaluation was carried out similarly in Example 1 and the results obtained are shown in Table 3.

TABLE 2

| Sample No. | Emulsion | Polymer Latex Compound | Polymer Latex Addition Amount (g/m$^2$) | Relative Sensitivity | Gradation | pressure Fog (g) | Preservability Sensitivity Change | Preservability Gradation Change | Remarks |
|---|---|---|---|---|---|---|---|---|---|
| 1-1 | A | Comparative Example A | 0.8 | 100 | 5.4 | 20 | +11 | −0.8 | Comparison |
| 1-2 | B | — | — | 120 | 6.2 | 10 | +12 | −0.9 | " |
| 1-3 | " | Comparative Example A | 0.8 | 118 | 6.4 | 20 | +2 | −0.1 | " |
| 1-4 | " | P-1 | " | 119 | 6.3 | 70 | +2 | −0.2 | Invention |
| 1-5 | C | " | " | 121 | 6.5 | 80 | +6 | −0.5 | " |
| 1-6 | D | " | " | 120 | 6.4 | 70 | +3 | −0.2 | " |
| 1-7 | B | " | 0.3 | 121 | 6.6 | 75 | +2 | −0.1 | " |
| 1-8 | " | P-6 | 0.8 | 117 | 6.2 | 80 | +2 | −0.2 | " |
| 1-9 | " | P-9 | " | 119 | 6.4 | 90 | +3 | −0.1 | " |
| 1-10 | " | P-13 | " | 120 | 6.5 | 75 | +2 | −0.1 | " |

Comparative Example A: Latex copolymer of methyl acrylate/2-acetoacetoxyethyl methacrylate/sodium 2-acrylamido-2-methylpropanesulfonate (88/5/7)

As is apparent from the results in Table 2, Samples (1-4) to (1-10) of the present invention exhibited high γ and good pressure characteristics and reduced black peppers.

The composition of Developing Solution 1 is described below.

| | |
|---|---|
| Potassium Hydroxide | 35.0 g |
| Diethylenetriaminepentaacetic Acid | 2.0 g |
| Potassium Carbonate | 12.0 g |
| Sodium Metabisulfite | 40.0 g |
| Potassium Bromide | 3.0 g |
| Hydroquinone | 25.0 g |
| 5-Methylbenzenetriazole | 0.08 g |
| 4-Hydroxymethyl-4-methyl-1-phenyl-3-pyrazolidone | 0.45 g |

TABLE 3

| Sample No. | Emulsion | Nucleating Agent Compound | Nucleating Agent Addition Amount (mol/mol Ag) | Polymer Latex Compound | Polymer Latex Addition Amount ($g/m^2$) | Relative Sensitivity | Gradation | Pressure Fog (g) | Preservability Sensitivity Change | Preservability Gradation Change | Remarks |
|---|---|---|---|---|---|---|---|---|---|---|---|
| 2-1 | B | — | — | Comparative Example A | 0.8 | 100 | 5.4 | 30 | +11 | −0.8 | Comparison |
| 2-2 | " | III-38 | $8 \times 10^{-4}$ | Comparative Example A | " | 120 | 18.3 | 20 | +20 | −5.2 | " |
| 2-3 | " | " | " | P-1 | " | 121 | 17.9 | 65 | +3 | −1.0 | Invention |
| 2-4 | " | " | " | " | 0.3 | 120 | 18.0 | 70 | +4 | −1.2 | " |
| 2-5 | " | " | " | P-6 | 0.8 | 123 | 19.2 | 60 | +3 | −1.2 | " |
| 2-6 | " | " | " | P-9 | " | 125 | 18.5 | 55 | +3 | −1.3 | " |
| 2-7 | " | III-33 | " | P-1 | " | 122 | 18.6 | 60 | +3 | −1.1 | " |
| 2-8 | " | " | " | P-6 | " | 120 | 19.1 | 70 | +4 | −1.3 | " |
| 2-9 | " | " | " | P-9 | " | 121 | 18.7 | 75 | +3 | −1.1 | " |
| 2-10 | C | III-38 | " | P-1 | " | 120 | 14.3 | 70 | +15 | −4.2 | " |
| 2-11 | D | " | " | " | " | 119 | 18.2 | 65 | +3 | −1.3 | " |

As is apparent from the results in Table 3, Samples (2-3) to (2-11) of the present invention exhibit high γ and good pressure characteristics and preservability.

Example 3

Emulsions E to G were prepared as described below.

Emulsion E:

A 0.13M aqueous solution of silver nitrate and an aqueous solution of halide salt containing $1.5\times10^{-7}$ mol per mol of Silver of $(NH_4)_2Rh(H_2O)Cl_5$, $2\times10^{-7}$ mol per mol of silver of $K_3IrCl_6$, 0.04M of potassium bromide and 0.09M of sodium chloride were added to an aqueous gelatin solution containing sodium chloride and 1,3-dimethyl-2-imidazolidinethione with stirring by a double jet method at 50° C. over a period of 12 minutes to obtain silver chlorobromide grains having an average grain size of 0.14 μm and a silver chloride content of 70 mol % so that nucleus formation was effected. Subsequently, a 0.87M aqueous solution of silver nitrate and an aqueous solution of halide salt containing 0.26M of potassium bromide and 0.65M of sodium chloride were similarly added to the emulsion by a double jet method over a period of 20 minutes.

$1\times10^{-3}$ mol of an aqueous solution of KI was then added to the emulsion for conversion and the reaction product was then washed with water according to an ordinary flocculation method, and 40 g of gelatin per mol of silver was added to adjust the pH to 6.0, and the pAg to 7.5. The temperature was maintained at 65° C. 7 mg of sodium benzenethiosulfonate and 2 mg of benzenesulfinic acid, per mol of silver, respectively, 8 mg of chloroauric acid, 200 mg of potassium thiocyanate and 5 mg of sodium thiosulfate were added to the emulsion and chemical sensitization was conducted so as to provide optimal sensitivity. Subsequently, 150 mg of 4-hydroxy-6-methyl-1,3,3a,7-tetraazaindene as a stabilizer was added and further 100 mg of proxel was added as a preservative. After then, the temperature was adjusted to 55° C., and the following Dyes 1 and 2 were added thereto so as to obtain a weight of 100 mg per mol of silver, with stirring for 15 minutes. Thus, Emulsion E of cubic silver chloroiodobromide having an average grain size of 0.4 μm and a silver chloride content of 69.9 mol % was obtained (comparative emulsion). Similarly, Emulsions F and G shown in Table. 4 were prepared. Further, conditions of chemical sensitization with respect to Emulsions F and G were changed as follows.

Dye 1

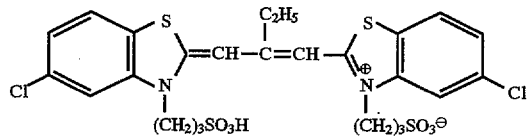

Dye 2

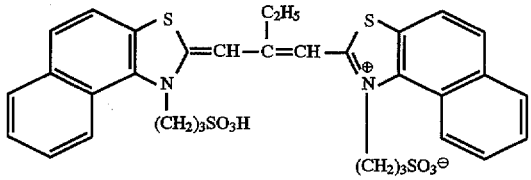

Preparation of Emulsion F

Emulsion F was prepared in the same manner as the preparation of Emulsion E except that chemical sensitization conditions were changed as follows: pH: 5.9, pAg: 7.5, temperature: 65° C., sodium thiosulfate: 2.0 mg, triphosphine selenide: 3.0 mg, chloroauric acid: 6 mg, sodium benzenethiosulfonate: 4 mg, sodium benzenesulfinate: 1 mg. (the present invention)

Preparation of Emulsion G

Emulsion G was prepared in the same manner as the preparation of Emulsion E except that chemical sensitization conditions were changed as follows: pH: 5.9, pAg: 7.5, temperature: 65° C., sodium thiosulfate: 2.0 mg, triphosphine telluride: 3.0 mg, chloroauric acid: 6 mg, sodium benzenethiosulfonate: 4 mg, sodium benzenesulfinate: 1 mg. (the present invention)

Preparation of Coated Samples 2.5 g, 50 mg, 50 mg, per mol of silver, respectively, of hydroquinone, 1-phenyl-5-mercaptotetrazole, and Compound (1) shown below as antifoggants, 400 $mg/m^2$ of colloidal silica having a particle size of 10 mμ, 25% with respect to the gelatin binder of polyethyl acrylate latex for improving dimensional stability, the latexes of the present invention in the amounts shown in Table 5 and, further, 2-bis(vinylsulfonylacetamido)ethane (35 mg/g of gelatin) as a hardening agent were added to the above Emulsions E to G, and the emulsions were coated on polyester supports so as to provide a coated silver weight of 4.0 g/m$^2$ and a coated weight ratio of gelatin in the emulsion layer per silver as shown in Table 5. The lower and upper protective layers of the compositions shown below were coated on the emulsion layer at the same time.

Compound (1)

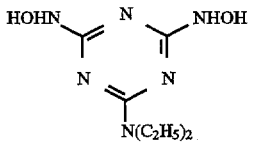

| Lower Protective Layer | |
|---|---|
| Gelatin | 0.5 g |
| Sodium Benzenethiosulfonate | 2 mg |
| 1,5-Dihydroxy-2-benzaldoxime | 25 mg |
| 5-Chloro-8-hydroxyquinoline | 5 mg |
| Polyethyl Acrylate Latex | 160 mg |
| **Upper Protective Layer** | |
| Gelatin | 0.4 g |
| Silica Matting Agent (average particle size: 3.0 μm) | 150 mg |
| Silicone Oil | 100 mg |
| Colloidal Silica (particle size: 10 mμ) | 30 mg |
| $C_8F_{17}.SO_2.N.(C_3H_7)CH_2COOK$ | 5 mg |
| Sodium Dodecylbenzenesulfonate | 22 mg |

Further, the support used in this example had a backing layer and a backing protective layer of the compositions shown below.

| Backing Layer | |
|---|---|
| Gelatin | 2.0 g/m$^2$ |
| Sodium Dodecylbenzenesulfonate | 80 mg/m$^2$ |
| Compound (3) | 70 mg/m$^2$ |
| Compound (4) | 70 mg/m$^2$ |
| Compound (5) | 90 mg/m$^2$ |
| 1,3-Divinylsulfonyl-2-propanol | 60 mg/m$^2$ |
| **Backing Protective Layer** | |
| Gelatin | 0.5 g/m$^2$ |
| Polymethyl Methacrylate (particle size: 4.7 μm) | 30 mg/m$^2$ |
| Sodium Dodecylbenzenesulfonate | 20 mg/m$^2$ |
| Compound (2) | 2 mg/m$^2$ |
| Silicone Oil | 100 mg/m$^2$ |

Compound (2)

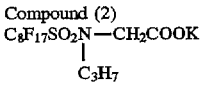

Compound (3)

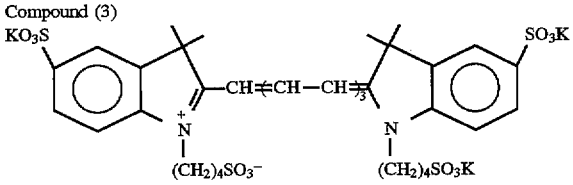

-continued

Compound (4)

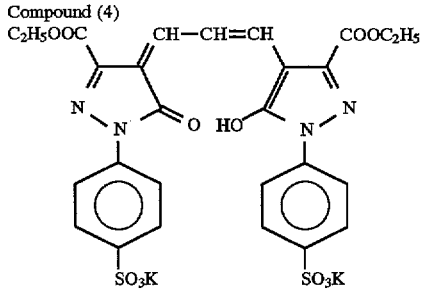

Compound (5)

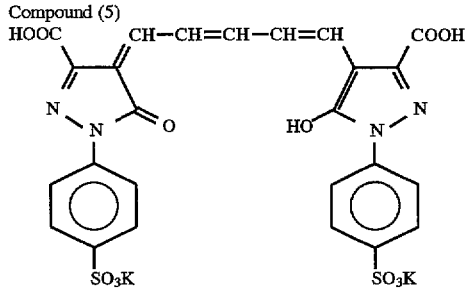

Evaluation of Samples

Photographic Characteristics 1

The samples-obtained were exposed with a xenon flash light with an exposure time of $10^{-5}$ sec through an interference filter having a peak at 670 nm and sensitometry was carried out at the temperature and time indicated below using an automatic processor FG-710NH (manufactured by Fuji Photo film Co., Ltd.).

Developing solution (2) and fixing solution (1) having the compositions shown below were used respectively as the developing solution and fixing solution.

| | Temperature (°C.) | Time (sec) |
|---|---|---|
| Development | 38 | 14 |
| Fixing | 37 | 9.7 |
| Washing | 26 | 9 |
| Squeegee | — | 2.4 |
| Drying | 55 | 8.3 |
| Total | — | 43.4 |

The reciprocal of the exposure amount providing a density of 3.0 was taken as the sensitivity and is expressed by a relative value in Table 5. Further, the gradient of the straight line connecting the points of density 0.1 and 3.0 on the characteristic curve was taken as the gradation and is also shown in Table 5.

Photographic Characteristics 2

A film having a halogen composition of $AgBr_{30}Cl_{70}$ and coated silver amount of 3.6 g/m$^2$ was blackening exposed by 60%, then 600 m$^2$ of the film was processed using Developing Solution (2) by an automatic processor FG-710NH with the replenishment rate of the developing solution replenisher being 180 cc/m$^2$, to thereby obtain a running solution. The same evaluation as photographic characteristics 1 was carried out Using this running solution.

Preservability

After the samples were allowed to stand for 20 days under 55% humidity at 40° C., sensitometry was carried out according to conditions described above at photographic characteristics 1 and evaluation was conducted. (The difference in sensitivity between photographic characteristics 1 was shown as ΔlogE.)

TABLE 4

| Emulsion No. | Composition | Rhodium.Ruthenium Complex kind | Position Added (mol/mol Ag) | Amount Added | $K_3IrCl_6$ Position Added (mol/mol Ag) | Amount Added | Chemical sensitizer | Remarks |
|---|---|---|---|---|---|---|---|---|
| E | $ArBr_{30}Cl_{69.9}I_{0.1}$ | $(NH_4)_2Rh(H_2O)Cl_5$ | core | $1.5 \times 10^{-7}$ | C/S | $2 \times 10^{-7}$ | Au/S | Comparison |
| F | $AgBr_{30}Cl_{69.9}I_{0.1}$ | $(NH_4)_2Rh(H_2O)Cl_5$ | core | $1.5 \times 10^{-7}$ | C/S | $2 \times 10^{-7}$ | Au/S/Se | Invention |
| G | $AgBr_{30}Cl_{69.9}I_{0.1}$ | $(NH_4)_2Rh(H_2O)Cl_5$ | core | $1.5 \times 10^{-7}$ | C/S | $2 \times 10^{-7}$ | Au/S/Te | Invention |

TABLE 5

| Sample | Emulsion | Polymer Latex Compound | Amount Added ($g/m^2$) | Gel/Ag Weight Ratio | Photographic Characteristics 1 Sensitivity | γ | Photographic Characteristics 2 Sensitivity | γ | Preservability ΔlogE | γ |
|---|---|---|---|---|---|---|---|---|---|---|
| 3-1 | E | — | — | 0.4 | 100 | 6.5 | 91 | 5.0 | +0.08 | 5.5 |
| 3-2 | " | P-1 | 0.5 | " | 98 | 6.4 | 91 | 5.3 | +0.03 | 5.9 |
| 3-3 | " | " | " | 0.7 | 98 | 6.4 | 93 | 5.4 | +0.04 | 5.9 |
| 3-4 | " | P-13 | 0.5 | 0.4 | 100 | 6.5 | 95 | 5.3 | +0.03 | 6.0 |
| 3-5 | F | P-1 | 0.5 | 0.7 | 110 | 6.6 | 102 | 5.7 | +0.10 | 5.4 |
| 3-6 | " | — | — | 0.4 | 107 | 6.6 | 92 | 6.0 | +0.04 | 6.2 |
| 3-7 | " | P-1 | 0.5 | " | 107 | 6.5 | 105 | 6.0 | +0.04 | 6.2 |
| 3-8 | " | P-13 | " | " | 110 | 6.6 | 105 | 6.1 | +0.04 | 6.3 |
| 3-9 | G | P-1 | 0.5 | 0.7 | 110 | 6.6 | 100 | 5.8 | +0.12 | 5.3 |
| 3-10 | " | — | — | 0.4 | 110 | 6.5 | 91 | 5.7 | +0.04 | 6.1 |
| 3-11 | " | P-1 | 0.5 | " | 110 | 6.6 | 105 | 6.1 | +0.04 | 6.2 |
| 3-12 | " | P-13 | " | " | 110 | 6.5 | 105 | 6.1 | +0.04 | 6.2 |

As can be seen from the results in Table 5, the samples of the present invention exhibit less degradation in photographic characteristics by processing with the running solution and also show good preservability.

| Developing Solution (2) | |
|---|---|
| Potassium Hydroxide | 35.0 g |
| Diethylenetriaminepentaacetic Acid | 2.0 g |
| Potassium Carbonate | 12.0 g |
| Sodium Metabisulfite | 40.0 g |
| Potassium Bromide | 3.0 g |
| Hydroquinone | 25.0 g |
| 5-Methylbenzenetriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 9 |
| Sodium 2-Mercaptobenzimidazole-5-sulfonate | 0.15 g |
| Sodium Erysolvate | 3.0 g |
| Water to make | 1 liter |
| (potassium hydroxide was added to adjust pH to 10.5) | |

| Fixing Solution (1) | |
|---|---|
| Ammonium Thiosulfate | 359.1 ml |
| Disodium Ethylenediaminetetraacetate Dihydrate | 2.26 g |
| Sodium Thiosulfate Pentahydrate | 32.8 g |
| Sodium Sulfite | 64.8 g |
| NaOH | 25.4 g |
| Glacial Acetic Acid | 87.3 g |
| Sodium Gluconate | 26.2 g |

-continued

| | |
|---|---|
| Aluminum Sulfate | 25.3 g |
| Water to make | 1 liter |
| (sulfuric acid or sodium hydroxide was added to adjust pH to 4.85) | |

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, wherein the emulsion of said emulsion layer comprises silver halide grains sensitized with a selenium or tellurium sensitizer and having a silver chloride content of 50 mol % or more, and said silver halide emulsion layer or other hydrophilic colloid layer contains polymer latex represented by the following formula (I):

$$-(D)_w-(A)_x-(B)_y-(C)_z- \quad (I)$$

wherein D represents a repeating unit derived from an ethylenically unsaturated monomer having an active methylene group, A represents a repeating unit derived from an ethylenically unsaturated monomer the homopolymer of which has a glass transition temperature of 35° C. or less, other than D, B represents a repeating unit derived from an ethylenically unsaturated monomer, other than D and A, C represents a repeating unit derived from an ethylenically unsaturated monomer having a carboxyl group, and w, x, y and z each represents percent by weight ratio of each component, w is from 0.5 to 40, x is from 60 to 99, y is from 0 to 50, and z is from 0.5 to 20, and w+x+y+z=100.

2. A silver halide photographic material as claimed in claim 1, wherein said silver halide emulsion layer or other hydrophilic colloid layer contains a hydrazine compound represented by the following formula (II):

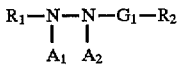

(II)

wherein $R_1$ represents an aliphatic group or an aromatic group, $R_2$ represents a hydrogen atom, an alkyl group, an aryl group, an unsaturated heterocyclic group, an alkoxy group, an aryloxy group, an amino group, or a hydrazino group, $G_1$ represents a —CO— group, an —$SO_2$— group, an —SO— group, a

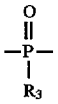

group, a —CO—CO— group, a thiocarbonyl group, or an iminomethylene group, $A_1$ and $A_2$ each represents a hydrogen atom, or one of them represents a hydrogen atom and the other represents an alkylsulfonyl group, an arylsulfonyl group, or an acyl group, and $R_3$ is selected from the group as defined for $R_2$, and $R_3$ may be different from $R_2$.

3. A silver halide photographic material as claimed in claim 1, wherein gelatin/silver weight ratio in said emulsion layer is 0.5 or less.

4. A silver halide photographic material as claimed in claim 2, wherein gelatin/silver weight ratio in said emulsion layer is 0.5 or less.

5. A development processing method of a silver halide photographic material comprising a support having thereon at least one light-sensitive silver halide emulsion layer, wherein the emulsion of said emulsion layer comprises silver halide grains sensitized with a selenium or tellurium sensitizer and having a silver chloride content of 50 mol % or more, and said silver halide emulsion layer or other hydrophilic colloid layer contains polymer latex represented by the following formula (I):

$$—(D)_w—(A)_x—(B)_y—(C)_z— \quad (I)$$

wherein D represents a repeating unit derived from an ethylenically unsaturated monomer having an active methylene group, A represents a repeating unit derived from an ethylenically unsaturated monomer the homopolymer of which has a glass transition temperature of 35° C. or less, other than D, B represents a repeating unit derived from an ethylenically unsaturated monomer, other than D and A, C represents a repeating unit derived from an ethylenically unsaturated monomer having a carboxyl group, and w, x, y and z each represents percent by weight ratio of each component, w is from 0.5 to 40, x is from 60 to 99, y is from 0 to 50, and z is from 0.5 to 20, and w+x+y+z=100, wherein the processing is carried out by an automatic processor in the total processing time of from 15 to 60 seconds.

6. A development processing method as claimed in claim 5, wherein said silver halide emulsion layer or other hydrophilic colloid layer contains a hydrazine compound represented by the following formula (II):

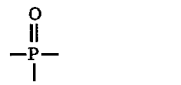

(II)

wherein $R_1$ represents an aliphatic group or an aromatic group, $R_2$ represents a hydrogen atom, an alkyl group, an aryl group, an unsaturated heterocyclic group, an alkoxy group, an aryloxy group, an amino group, or a hydrazino group, $G_1$ represents a —CO— group, an —$SO_2$— group, an —SO— group, a group, a—CO—CO— group, a thiocarbonyl group, or an iminomethylene group, $A_1$ and $A_2$ each represents a hydrogen atom, or one of them represents a hydrogen atom and the other represents an alkylsulfonyl group, an arylsulfonyl group, or an acyl group, and $R_3$ is selected from the group as defined for $R_2$, and $R_3$ may be different from $R_2$.

7. A development processing method as claimed in claim 5, wherein gelatin/silver weight ratio in said emulsion layer is 0.5 or less.

8. A development processing method as claimed in claim 5, wherein the processing is carried out by an automatic processor of line speed of 1,000 mm/min or more.

9. A development processing method as claimed in claim 6, wherein the processing is carried out by an automatic processor of line speed of 1,000 mm/min or more.

10. A development processing method as claimed in claim 7, wherein the processing is carried out by an automatic processor of line speed of 1,000 mm/min or more.

11. A silver halide photographic material as claimed in claim 2, wherein $A_1$ and $A_2$ are unsubstituted.

12. A silver halide photographic material as claimed in claim 6, wherein $A_1$ and $A_2$ are unsubstituted.

13. A silver halide photographic material as claimed in claim 2, wherein one of $A_1$ and $A_2$ in formula (II) represents an alkylsulfonyl group having 20 or less carbon atoms, an arylsulfonyl group having 20 or less carbon atoms, or an acyl group having 20 or less carbon atoms, said alkylsulfonyl, arylsulfonyl or acyl group being substituted by a halogen, an ether, a sulfonamide, a carbonamide, a hydroxyl, a carboxyl or a sulfonic acid.

14. A silver halide photographic material as claimed in claim 6, wherein one of $A_1$ and $A_2$ in formula (II) represents an alkylsulfonyl group having 20 or less carbon atoms, an arylsulfonyl group having 20 or less carbon atoms, or an acyl group having 20 or less carbon atoms, said alkylsulfonyl, arylsulfonyl or acyl group being substituted by a halogen, an ether, a sulfonamide, a carbonamide, a hydroxyl, a carboxyl or a sulfonic acid.

15. A silver halide photographic material as claimed in claim 1, wherein the repeating unit derived from the ethylenically unsaturated monomer having an active methylene group and represented in formula (I) by D is represented by the following formula (IV):

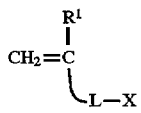

(IV)

wherein $R^1$ represents a hydrogen atom, an alkyl group having from 1 to 4 carbon atoms or a halogen atom;

X represents $R^8$—CO—$CH_2$—COO—, NC—$CH_2$—COO—, $R^8$—CO—$CH_2$—CO— or $R^8$—CO—$CH_2$—CON($R^5$)— in which $R^5$ has the same meaning as below; and in which $R^8$ represents an alkyl group having from 1 to 12 carbon atoms, an aryl group, an alkoxy group, a cycloalkyloxy group, an aryloxy group or an amino group; and L represents a single bond or a divalent linking group represented by the following formula:

$$-(L^1)_m-(L^2)_n-$$

wherein $L^1$ represents —CON($R^2$)— in which $R^2$ represents a hydrogen atom or an alkyl group having from 1 to 4 carbon atoms or a substituted alkyl group having from 1 to 6 carbon atoms, —COO—, —NHCO—, —OCO—,

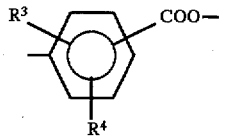

in which $R^3$ and $R^4$ each represents hydrogen, hydroxyl, halogen, alkyl, alkoxy, acyloxy or aryloxy, or or

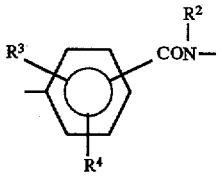

in which $R^2$, $R^3$ and $R^4$ are as defined above;

m represents 0 or 1;

n represents 0 or 1; and $L^2$ represents a linking group which links $L^1$ with X, said linking group being represented by the following formula $$-(X^1-(J^1-X^2)_p-(J^2-X^3)_q-(J^3)_r-)_s-$$

wherein $J^1$, $J^2$ and $J^3$ may be the same or different and each represents —CO—, —$SO_2$—, —CON($R^5$)—, —$SO_2$N($R^7$)—, —N($R^5$)—$R^6$—, —N($R^5$)—$R^6$—N($R^7$)—, —O—, —S—, —N($R^5$)—CO—N($R^7$)—, —N($R^5$)—$SO_2$—N($R^7$)—, —COO—, —OCO—, —N($R^5$)$CO_2$— and —N($R^5$)CO— in which $R^5$ represents hydrogen or alkyl having 1 to 6 carbon atoms, in which $R^6$ represents alkylene having 1 to 4 carbon atoms, and in which $R^7$ represents hydrogen, alkyl having 1 to 6 carbon atoms, p, q, r and s each represents 0 or 1; and $X^1$, $X^2$ and $X^3$ represents an alkylene group having from 1 to 10 carbon atoms, an aralkylene group, or a phenylene group and the alkylene group may be straight chain or branched.

16. A silver halide photographic material as claimed in claim 15, wherein X represents $R^8$—CO—$CH_2$—COO—.

17. A silver halide photographic material as claimed in claim 15, wherein X represents NC—$CH_2$—COO—.

18. A silver halide photographic material as claimed in claim 15, wherein X represents $R^8$—CO—$CH_2$—CO—.

19. A silver halide photographic material as claimed in claim 15, wherein X represents $R^8$—CO—$CH_2$—CON($R^5$)—.

* * * * *